US005102767A

United States Patent [19]

Chowdry et al.

[11] Patent Number: 5,102,767

[45] Date of Patent: Apr. 7, 1992

[54] TRANSFER TECHNIQUE FOR SMALL TONER PARTICLES

[75] Inventors: Arun Chowdry, Pittsford; Dennis R. Kamp, Spencerport; Donald S. Rimai, Webster, all of N.Y.

[73] Assignee: Eastman Kodak Company, Rochester, N.Y.

[21] Appl. No.: 489,320

[22] Filed: Mar. 5, 1990

[51] Int. Cl.[5] ..... G03G 13/14

[52] U.S. Cl. ..... 430/126

[58] Field of Search ..... 430/126

[56] References Cited

U.S. PATENT DOCUMENTS 4,370,400 1/1983 Cooper et al. ..... 430/126

4,927,727 5/1990 Rimai et al. ..... 430/99

*Primary Examiner*—Marion E. McCamish
*Assistant Examiner*—S. Crossan
*Attorney, Agent, or Firm*—Dressler, Goldsmith, Shore, Sutker & Milnamow, Ltd.

[57] ABSTRACT

A process is disclosed for making high resolution copies wherein a toned image is formed on a receiver. First, a uniform coating of nonmarking toner particles is transferred to the surface of a receiver. Next, a latent electrostatic image is developed and transferred to the coated receiver and the toned image is heat fused. Thus, the receiver has heat fused thereto a continuous coating of the nonmarking toner which is overlaid by a toned image of the marking toner.

18 Claims, No Drawings

TRANSFER TECHNIQUE FOR SMALL TONER PARTICLES

FIELD OF THE INVENTION

The invention is in the field of thermally assisted toner transfer procedures.

BACKGROUND OF THE INVENTION

In electrostatic copying, an electrostatic latent image is formed on an element. That image can be developed into a visible image by the application of toner powder thereover. The resulting toned image is then transferred from the element to a receiver to which the transferred toned image is fixed, usually by heat fusion. The transfer of the toned image to the receiver has usually heretofore been accomplished electrostatically, using an electrostatic bias applied between the receiver and the element.

In order to produce copies of very high resolution, it is necessary to use toner particles that have a very small particle size, that is, less than about 8 microns.

Electrostatic transfer of such very small toner particles, particularly of those having a particle size less than about 6 microns, is difficult to accomplish because, the forces of adhesion holding the particles to the photoconductor are greater than the electrostatic transfer forces that can be applied. Moreover, Coulombic repulsion between the particles tends to scatter such particles causing loss in transferred image resolution and increase in grain and mottle. To avoid these problems a non-electrostatic transfer process must be used with toned images of such particles.

One suitable such transfer process is provided by the teaching of copending U.S. patent application Ser. No. 230,394 filed Aug. 9, 1988 wherein a thermally assisted transfer procedure is utilized. A receiver is heated, so that, in the transfer nip the temperature typically is in the range of about 60° to about 90° C., and is contacted against the toned image formed on the element. The heated receiver sinters the toner particles, causing them to stick to each other and to the receiver, thereby effecting a transfer of the toned image from the element to the receiver. The element and the receiver are separated, while still hot. Subsequently, the transferred toned image is fused to the receiver. This process is sometimes called the thermally assisted transfer process. This process is useful, but suffers from the disadvantage that, while scattering is avoided, some toner particles may not transfer from the element. Moreover, it is frequently necessary to add a release agent to the photoconductor. The use of a release agent can be avoided if a receiver bearing a thermoplastic resin is used. However, this restricts the types of receivers that can be used.

However, so far as now known, no thermally assisted transfer process is known by which a high resolution toner powder image comprised of very small toner particles can be transferred from an element to a receiver that is treated at the time of copying with a preliminary coating produced from toner particles.

SUMMARY OF THE INVENTION

This invention is directed to a process for producing a thermally assisted transferred toned image of small toner particles upon a receiver.

In one embodiment, the present invention is directed to a transfer method of producing a receiver first developing from approximately one to approximately three monolayers of a nonmarking (clear or uncolored) toner onto a member. The member need not be a photoconductor. Development can be accomplished by any suitable manner including corona charging the member and electrostatically depositing clear toner onto it, pouring the correct amount of toner onto it, etc. Preferable would be the use of a member which consists of or contains an electrically conductive element. This element is grounded. If desired a release agent can be used with the substrate. Toner is deposited onto the substrate using a biased magnetic development brush. The bias is set so that, preferably, the substrate is coated with at least one, but fewer than three, monolayers of nonmarking toner particles. The size of the particles is not critical but should have a median volume weighted diameter less than 12 μm but greater than approximately 4 μm. The size can be adjusted to allow good transfer to the receiver support. The nonmarking toner is transferred to the receiver (preferably paper) using any suitable technology. It is preferable to use thermal assisted transfer, especially if the nonmarking particles are less than approximately 8 μm diameter. The role of the nonmarking particles in this instance is to serve as a thermoplastic layer so as to augment the thermally assisted transfer of the marking particles. While the receiver can be used without further treatment, it is preferable to enhance the attachment of the nonmarking toner particles prior to the transfer of the imaging particles by fusing, ferrotyping, or any other appropriate means. The role of the nonmarking particles is to create a surface in which the imaging particles can partially embed. To create color images, appropriate separations can be transferred, in register, sequentially to the receiver. Alternatively, color separations can be developed in register, followed by the single transfer of the entire image to the nonmarking toner bearing receiver. Subsequent fixing can be done in any suitable manner. If desired a release agent can be used on the photoconductor to enhance transfer and the subsequent release of the receiver, preferably while still hot, from the photoconductor. To ensure good transfer and release, it is preferable that the layer of nonimaged toner have a surface energy between approximately 35 and 45 dynes/cm. The key features of this technology are:

A layer of nonimaging toner, which is greater than approximately one monolayer but not greater than approximately three monolayers, is developed onto a member. The nonmarking toner is then transferred to the receiver and, preferably, fixed to the receiver. The imaging toner is then transferred to the receiver using thermal assisted transfer. This requires that the toner partially embed into the layer created by the nonmarking particles and that the receiver be subsequently separable from the photoconductor. Subsequently, the image is permanently fixed to the receiver. Typical voltages needed to get good coverage of the clear toner are in the range of 100 to 400 volts, depending on toner charge.

In another embodiment of the present invention a direct method of producing a receiver for thermal assisted transfer is utilized. This technology is similar to that described above except that the nonmarking toner particles are directly deposited onto the receiver. While any appropriate method of deposition would do, the preferred mode is to use a magnetic brush, appropriately biased, to develop a layer of nonmarking toner on the receiver. To ensure proper development it is important that a grounded electrically conductive layer be behind the receiver during the development. While this can be done by appropriately coating the back of the receiver, it is preferable to have a metal plate behind the receiver. This process has the advantage over the transfer method process of not requiring the transfer of the nonmarking toner, thereby simplifying the process and the necessary equipment, and can, conceivably, operate at a higher process speed. However, the physical properties of the receiver result in the laydown of the nonmarking toner particles being distinctly less uniform that with the transfer method. Moreover, the nonuniformities of the receiver require that substantially higher voltages be used (typically 200-500 volts) in order to have adequate coverage. It is also important that, in this process, the image be permanently fixed to the support prior to the transfer of the marking particles. While any mode of fixation will suffice, the preferred method is ferrotyping.

The present invention also provides a new and improved class of imaged receivers that have heat fused on one surface thereof a continuous coating of nonmarking toner particles and an overcoated heat fused image comprised of imaging or marking toner particles.

The present invention provides techniques for electrographically producing high quality black and white copies or full color copies on graphic arts paper or other commercially available receiver sheets.

The present invention is advantageous as it permits the transfer of images to be made with toner powders having median volume weighted diameters of less than about 8 microns. It also permits the user to select a wide range of receivers while preserving the look and "feel" of the receiver.

The present invention extends the technology of the so called thermally assisted contact transfer process so that this process can be used with receivers, such as various kinds of paper, plastic sheets, and the like, which do not need to be specially prepared, as by the application of a polymer coating thereto, before being used as a substrate upon which a high resolution image comprised of small sized toner particles is formed. This eliminates the need for release agents on the photoconductor and permits the use of rougher receivers.

DETAILED DESCRIPTION

The term "particle size", as used herein, or the term "size", or "sized" as employed herein in reference to the term "particles", means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or "$T_g$" as used herein means the temperature at which an amorphous material changes from a glassy state to a liquid state. This temperature ($T_g$) can be measured by differential thermal analysis as disclosed in N. F. Mott and E. A. Davis, "Electronic Processes in Non-Crystalline Materials," Oxford Press (1971).

The term "melting temperature" or "$T_m$" as used herein means the temperature at which a crystalline material changes from a solid state to a liquid state. This temperature ($T_m$) can be measured by differential thermal analysis as disclosed above.

The term "surface tension" or "surface energy" as used herein means the energy needed to create a unit area of surface from the bulk of a given material. Surface tension or surface energy can be measured by the contact angle procedure disclosed in Rev. Mod. Phys. 57, 827-863 (1985).

The term "element" as used herein refers to any of the known electrographic elements including photoconductor elements, graphic elements, dielectric recording elements, and like electrographic elements. Examples of such elements can be found in, for instance, U.S. Pat. Nos. 4,175,960 and 3,615,414.

The term "receiver" as used herein refers to a substrate upon which a toner powder image is transferred and subsequently heat fused or otherwise permanently fixed. Examples of suitable substrates include paper, plastic film, such as films of polyethylene terephthalate, polycarbonate, or the like, which are preferably transparent and therefore useful in making transparencies, and the like. The substrate must not melt, soften, or lose mechanical integrity during transfer, sintering, or fixing of toner particles as taught herein. Preferred substrates do not readily absorb the thermoplastic polymer matrix nonmarking of the toner particles when the particles are being heat fused, so that the polymer tends to stay on the surface portions of a substrate and to form a good bond thereto. However, the image bearing toner may migrate into the clear toner layer. Substrates having a smooth surface will tend to result in a better quality heat fused image. Paper substrates preferably have an average surface roughness which is less than about 10 $\mu$m, as measured using a Surtronic-3 Profilometer manufactured by Rank Taylor Hobson. Paper is a presently preferred support. In general, a flexible receiver is particularly desirable.

The term "locations of contact" as used herein in relation to toner particles employed in the practice of this invention and to surfaces contacted thereby refers to localized regions on individual toner particle surfaces which are in contact either with one another, or with the surface upon which such a particle is deposited.

The term "sinters" or "sintering" as used herein in relation to toner particles employed in the practice of this invention refers to bonding or fusion that is thermally achieved at locations of contact existing either between adjacent toner particles or between toner particles and an adjacent surface. The term "sinter" and equivalent forms is distinguished for present purposes from a term such as "melts", "melting", "melt", "melt fusion" or "heat fusion." In heat fusion, in response to sufficient applied thermal energy, toner particles tend to lose their discrete individual identities to melt, and to blend together into a mass, as when a toner powder is heat fused and thereby bonded or fixed to a receiver.

The clear toner particles employed in the practice of this invention have a particle size in the range of about 3 to about 12 microns, and preferably in the range of about 5 to 9 microns. Such a particle size range is approximately commensurate with, for example, the roughness of preferred paper substrates used as receivers in the practice of the invention, thereby enhancing efficient transferability of the toner particles to the receivers. Smaller sized toner particles are difficult to deposit or transfer while larger toner particles create a thick thermoplastic polymeric layer on the receiver which may present difficulties in transferring an image, adversely affecting image quality or significantly altering the look or feel of the receiver.

The clear toner particles are comprised of a thermoplastic polymer which preferably has a glass transition temperature in the range of about 40° to about 80° C., although thermoplastic polymers which have somewhat higher and lower $T_g$s can be employed, if desired. Preferably such a thermoplastic polymer has a melting temperature ($T_m$) which is in the range of about 80° to about 120° C. although polymers with somewhat higher or lower melting temperatures can be used. Preferably, such a thermoplastic polymer also has a surface tension in the range of about 35 microns to about 45 dynes per centimeter, although thermoplastic polymers can have a somewhat higher or lower surface energy, if desired. Preferably a given group of such particles used in the practice of this invention has a narrow particle size distribution. For example, a size (standard) deviation in the range of about ±3 microns from a mean particle size is presently preferred, although somewhat larger and smaller such deviations can be employed, if desired.

The nonmarking toner particles preferably utilize a polymer which is substantially transparent to visible light. Such particles preferably contain substantially no colorant (i.e., a dye or pigment). However, if desired, a colorant may be incorporated into a group of particles whose color matches, or approximates, the color of a particular receiver with which the nonmarking particles are to be used.

The marking toner particles employed in the practice of the invention have a particle size in the range of about 3 to about 8 microns and are comprised of a thermoplastic polymer which, like the nonmarking toner particles, has a $T_g$ in the range of about 40° to about 80° C. The marking particles can have somewhat larger and smaller particle sizes and $T_g$s, if desired. Preferably such a thermoplastic polymer has a melting point or temperature ($T_m$) which is in the range of about 80° to about 120° C., although polymers with somewhat higher or lower melting temperatures can be used. The particle size distribution is preferably comparable to the distribution above indicated for the nonmarking particles.

The marking toner particles preferably are compounded with a colorant having the appropriate color for a desired toned image. Black is a preferred color. Multi-colored toned images can be transferred in accordance with this invention. If multi-colored toned images are contemplated, then the marking toner particles need to be compounded with appropriate colorants. Conventional colorants are employed.

The marking toner particles likewise preferably contain a charge agent incorporated thereinto. On a 100 weight percent basis, preferred marking toner particles comprise about 0.05 to about 5 weight percent of charge agent, about 5 to about 20 weight percent of colorant, and the balance thermoplastic polymer. Conventional charge agents can be used.

Both the nonmarking and the marking toner particles can be comprised of polymers such as, for example, amorphous polyesters, styrene butylacrylate copolymers, polystyrene, polyesteramides, and the like.

In both toner particles the polymer employed more preferably has a glass transition temperature or $T_g$ in the range of about 55° to 70° C. Preferably such toner particles also have relatively high caking temperatures, for example, higher than about 55° C., so that the toner powders can be stored for relatively long periods of time at relatively high temperatures with little or no individual particle agglomeration or clumping.

In the practice of the process of this invention, one first uniformly deposits upon a substrate a coating which is comprised of nonmarking toner particles, as above characterized. The coating is preferably fixed to the substrate by such processes as fusing, ferrotyping, etc. in the indirect transfer method while it must be fixed in the direct transfer method.

In general, a uniform coating of toner particles should cover substantially the entire surface of the receiver. The coating thickness should range from approximately a monolayer of the toner particles up to a thickness of about 3 monolayers of the toner particles, although lesser or greater thicknesses may be used if desired.

In one embodiment, a receiver is produced by first developing from about one to about three monolayers of a nonmarking (clear or uncolored) toner onto a member, preferably containing an electrically conductive suitable manner including corona charging the member and electrostatically depositing clear toner onto it, pouring the correct amount of toner onto it, etc. If desired a release agent can be used with the substrate. Toner is deposited onto the substrate using a biased magnetic development brush. The size of the particles is not critical but should have a median volume weighted diameter less than 12 μm but greater than approximately 4 μm. The size can be adjusted to allow good transfer to the receiver. The nonmarking toner is transferred to the receiver (preferably paper) by conventional means such as thermal assisted transfer, especially if the nonmarking particles are less than approximately 8 μm in diameter. While the receiver can be used without further treatment, it is preferable to enhance the attachment of the nonmarking toner particles prior to the transfer of the imaging particles by fusing, ferrotyping, or any other appropriate means to create a surface in which the imaging particles can partially embed. To create color images, appropriate separations can be transferred, in register, sequentially to the receiver. Alternatively, color separations can be developed in register, followed by the single transfer of the entire image to the nonmarking toner bearing receiver. Subsequent fixing can be done in any suitable manner. If desired a release agent can be used on the photoconductor to enhance transfer and the subsequent release of the receiver, preferably while still hot, from the photoconductor. To ensure good transfer and release, it is preferable that the layer of nonimaged toner have a surface energy between approximately 35 and 45 dynes/cm.

In another embodiment of the present invention a direct method of producing a receiver for thermal assisted transfer is utilized. This method is similar to that described above except that the nonmarking toner particles are directly deposited onto the receiver. While any appropriate method of deposition is suitable, the preferred mode is to use a magnetic brush, appropriately biased, to develop a layer of nonmarking toner on the receiver. To ensure proper development it is important that a grounded electrically conductive layer be behind the receiver during the development. While this can be done by appropriately coating the back of the receiver, it is preferable to have a metal plate behind the receiver. In this embodiment, the nonmarking toner attachment must be enhanced by fusing, ferrotyping, etc.

The term "release agent" as used herein refers to a substance which, when present at the time when two surfaces are contacted together particularly at elevated temperature, either prevents bonding or sticking from occurring between such surfaces or, if bonding does occur, causes a bond of such a low strength to result that the two surfaces can subsequently be separated without leaving any substantial fragments of one surface embedded in or adhering to the other. Preferred release agents for use in the present invention have a low surface energy which is preferably less than about 40 dynes/centimeter. A release agent should not be chemically reactive with a polymer or developer employed in the practice of this invention or otherwise affect the development process. Examples of suitable release agents for use in this invention include nonpolar compounds, such as hydrophobic metal salts of organic fatty acids, as for instance, zinc stearate, nickel stearate, zinc palmitate, and the like; polysiloxanes including siloxane copolymers, such as poly[4,4'-isopropylidene-diphenylene-co-block-poly(dimethylsiloxanediol) sebacate]; and the like; fluorinated hydrocarbons; perfluorinated polyolefins; semi-crystalline polymers, such as certain polyethylenes, polypropylenes, and the like. Polysiloxane release agents are presently preferred.

The process steps of this invention are suitable for a continuous process, such as in a document copying machine, or the like.

A receiver that has been produced in accordance with the process of this invention has on one surface thereof a continuous fixed coating of clear toner particles that has been overcoated with a heat fused toned image of marking toner particles.

The invention is illustrated by the following examples.

EXAMPLE 1

A black and white image consisting of both continuous tone and alpha-numeric regions is developed on the imagable surface of an organic photoconductor using a styrene butylacrylate based toner with a median volume weighted diameter of approximately 4.5 microns. The image is transferred to a graphic arts paper known as "Lustro Offset Enamel" toner available commercially from Warren Co. Transfer was accomplished by passage through the nip region of a pair of compression rollers. The roller contacting the toned image was heated to a temperature of 90° C. while the other was at ambient temperature. The passage speed was 1 in./sec. Air pressure to the cylinders compressing the rollers together was 40 psig. Only approximately ⅓ of the imaging toner transferred from the photoconductor to the paper, resulting in image quality that was commercially unacceptable.

EXAMPLE 2

The procedure of Example 1 was repeated except that prior to its being used for transfer, the Lustro Offset Enamel paper was coated with approximately a monolayer of clear, polyester toner having a median volume weighted diameter of approximately 5 microns. The clear toner was so coated onto such paper by first developing the toner layer on a film of polyethylene terephthalate (Estar TM available from Eastman Kodak Co.) having a chrome cermet layer. The cermet was grounded while the development station potential was set at 100 VDC. The clear toner was then transferred to the paper with the air pressure to the cylinders compressing the rollers at 40 psig and a paper preheat temperature of about 90° C. applied for a time of approximately 0.07 sec. The clear toner was heat fused after separation from the cermet surface at a temperature of about 60° C. and a air pressure of about 40 psig applied for 0.2 sec. against a piece of Kapton-H. The steps described in Example 1 were then repeated except that the treated paper was used as the receiver. Transfer was very good. Overall transfer efficiency was approximately 98%. Image quality was good.

EXAMPLE 3

The procedure used in this example was similar to Example 1 except that a graphic arts paper sold by Champion Paper Co. under the name "Kromekote" was used as the receiver. Results were similar to those obtained in Example 1. Transfer efficiency was only about ⅓, resulting in image degradation.

EXAMPLE 4

The procedure used in this example was similar to that described in Example 2 except that Kromekote paper was used instead of the Lustro Offset Enamel. Transfer efficiency was high (approximately 98%). Resulting image quality was good.

EXAMPLE 5

A color image was made using the techniques described herein. Clear toner was deposited and fixed on a piece of Kromekote paper in the manner described in Example 2. Cyan, magenta, and yellow separations were then developed on separate pieces of organic photoconductor with approximately 3.5 um diameter toner particles and sequentially transferred to the treated papers, in register, using a preheat temperature of about 90° C., an air pressure driving the compression rollers of about 40 psig and an application time of about 0.07 sec. The image was subsequently fixed by the procedure of Example 2. Each separation transferred with an efficiency greater than 99%. Image quality was good.

The invention has been described in detail with particular reference to preferred embodiments thereof, but it will be understood that variations and modifications can be effected within the spirit and scope of the invention.

We claim:

1. A process for producing a thermally assisted transferred toned image comprising the steps of:
   (a) depositing upon a substrate a uniform coating comprised of nonmarking toner particles;
   (b) transferring said coating to a receiver substrate;
   (c) contacting the coated receiver against the surface of an element which has thereon a transferrable toned image comprised of marking toner particles thereby transferring said toned image from said element to said coated receiver while heating said receiver to a temperature which sinters said marking toner particles at their locations of contact to said coating and to each other; and
   (d) separating said receiver from said element.

2. The process of claim 1 wherein said receiver is subjected to temperatures sufficient to heat fuse said nonmarking toner particles.

3. The process of claim 1 wherein steps (a) and (b) are carried out by electrostatically depositing a uniform coating of said nonmarking toner particles upon a substrate, and then contacting said coating with said receiver while heating said receiver to a temperature which sinters said nonmarking toner particles at their locations of contact to said receiver and to each other, thereby transferring said coating from said substrate to said receiver.

4. The process of claim 3 wherein said substrate is a photoconductor element.

5. The process of claim 3 wherein said substrate comprises a support layer and an electrically conductive layer bonded thereto.

6. The process of claim 3 wherein said substrate is preliminarily coated with a release agent.

7. The process of claim 3 wherein said nonmarking toner particles are admixed with a release agent.

8. The process of claim 7 wherein said release agent is a polysiloxane.

9. The process of claim 1 wherein the coating that is comprised of said nonmarking toner particles has a thickness in the range of about one to about three monolayers of said nonmarking toner particles.

10. The process of claim 1 wherein said receiver substrate comprises paper.

11. A process for producing a thermally assisted transferred toned image comprising the steps of:

(a) depositing upon a receiver substrate a uniform coating comprised of nonmarking toner particles;

(b) fixing said coating;

(c) contacting the coated receiver against the surface of an element which has thereon a transferrable toned image comprised of marking toner particles thereby transferring said toned image from said element to said coated receiver while heating said receiver to a temperature which sinters said marking toner particles at their locations of contact to said coating and to each other; and (d) separating said receiver from said element.

12. The process of claim 11 wherein said receiver is subjected to temperatures sufficient to heat fuse said nonmarking toner particles.

13. The process of claim 11 wherein said receiver comprises a support layer and an electrically conductive layer bonded thereto.

14. The process of claim 11 wherein said nonmarking toner particles are admixed with a release agent.

15. The process of claim 14 wherein said release agent is a polysiloxane.

16. The process of claim 11 wherein the coating that is comprised of said nonmarking toner particles has a thickness in the range of about one to three monolayers of said nonmarking toner particles.

17. The process of claim 11 wherein said receiver substrate comprises paper.

18. A receiver which has fixed on one surface thereof a continuous coating of nonmarking toner particles and an overcoated image of marking toner particles.

* * * * *